US007264228B2

(12) United States Patent
Kaiser et al.

(10) Patent No.: US 7,264,228 B2
(45) Date of Patent: Sep. 4, 2007

(54) COUNTERWEIGHT ASSISTED WINCH

(75) Inventors: Rodney F. Kaiser, Syracuse, NY (US); Thomas S. Young, Jamesville, NY (US)

(73) Assignee: J. R. Clancy, Inc., Syracuse, NY (US)

( * ) Notice: Subject to any disclaimer, the term of this patent is extended or adjusted under 35 U.S.C. 154(b) by 0 days.

(21) Appl. No.: 11/162,431

(22) Filed: Sep. 9, 2005

(65) Prior Publication Data

US 2007/0063175 A1 Mar. 22, 2007

(51) Int. Cl.
*B66D 1/36* (2006.01)

(52) U.S. Cl. ..... 254/338; 254/358

(58) Field of Classification Search ..... 254/338, 254/358, 372

See application file for complete search history.

(56) References Cited

U.S. PATENT DOCUMENTS 414,380 A * 11/1889 Dingee ..... 187/257
2,649,279 A * 8/1953 Jones et al. ..... 254/329
3,103,344 A * 9/1963 Figge ..... 254/338
3,572,599 A * 3/1971 Hilmer ..... 254/358
3,697,047 A * 10/1972 Cruse ..... 472/78
3,810,529 A * 5/1974 Tosato et al. ..... 187/265
3,917,230 A * 11/1975 Barron ..... 254/270
4,842,101 A * 6/1989 Lamb ..... 187/266
5,996,970 A * 12/1999 Auerbach ..... 254/288
6,209,852 B1 * 4/2001 George et al. ..... 254/372

FOREIGN PATENT DOCUMENTS

JP 406191795 A * 7/1994
JP 2001-233589 * 8/2001

* cited by examiner

*Primary Examiner*—Emmanuel M Marcelo
(74) *Attorney, Agent, or Firm*—George R. McGuire; David L. Nocilly; Bond, Schoeneck & King, PLLC

(57) ABSTRACT

The invention is a motorized winch which can be retrofitted into existing manually operated systems that use counterbalancing weights. The counterbalancing weight will be fixed at 50% of the maximum capacity of the set. The winch is rated at 50% of the maximum capacity of the set. By using the winch in a closed loop configuration, it will operate the set at any load from 0 to 100% of its rated capacity, without the need to ever adjust the counterbalancing weights.

9 Claims, 3 Drawing Sheets

COUNTERWEIGHT ASSISTED WINCH

BACKGROUND OF THE INVENTION

The present invention relates generally to theatrical rigging systems, and more particularly to rigging systems that utilize counterweights to raise and lower the load.

Most existing rigging systems use manually operated rigging sets (or "sets"), which are counterbalanced with weights for ease of operation. When loads (scenery, curtains, lighting equipment, etc.) are changed, the counterbalancing weights must be adjusted to properly balance the load. This normally happens when the load is at floor level and counterbalancing weights are substantially above the floor, making access difficult.

In their most basic form, conventional rigging sets, such as the one illustrated in FIG. 1 and designated generally by reference numeral 10, comprise a locking rail 12 fixed to the floor, a tensioning floor block 14 around which a control line 16 passes, a counterweight arbor 18 the opposing sides to which opposite ends of the control line 16 attach, a head block 20 around which control line 16 passes and which gather lift lines 22 that otherwise extend between arbor 18 and a batten 26 to which the load is attached. To raise and lower batten 26, counterweights must be removed from or added to arbor 18. This requires the rigging operator to manually remove or place weights onto arbor 18 generally at a relatively significant height.

In addition, it is necessary to ensure that a rope lock 28 is engaged to prevent sudden movement of the control line and counterweights when the operator balances the load with the counterweights. If the rope lock 28 fails or is not engaged in the first place, the arbor will rise or fall at significant speed, inevitably causing serious injury and perhaps killing the operator. In addition, the amount to balance the load must be done perfectly in order to prevent the load from being moved too rapidly which in and of itself can cause injury or death to the operator and the people on the stage below the load.

Many of these rigging systems are used in middle school and high school theatres. There are concerns about the ability of the operators (frequently students) to properly balance the loads, and the requirement for the balancing work to be done at substantial heights.

SUMMARY OF THE INVENTION

One aspect of the invention contemplates a counterweight balanced rigging system for raising and lowering a load of predetermined weight, comprising a winch having a rating of at least one half the predetermined weight; an arbor having counterweights positioned thereon, wherein the weight of the counterweights is about one half of the predetermined weight; a first control line interconnecting the arbor to the load; and a second control line interconnected between the arbor and the first control line and positioned in movingly and lockingly engaged relation to the winch.

By eliminating the need to adjust counterbalancing weights on a regular basis, operational safety and convenience are improved.

In addition to being used as a retrofit device, this device can be used in new installations in conjunction with a fixed counterweight set.

BRIEF DESCRIPTION OF THE DRAWINGS

The present invention will be more fully understood and appreciated by reading the following Detailed Descript no in conjunction with the accompanying drawings, in which.

DETAILED DESCRIPTION

Figure 1:
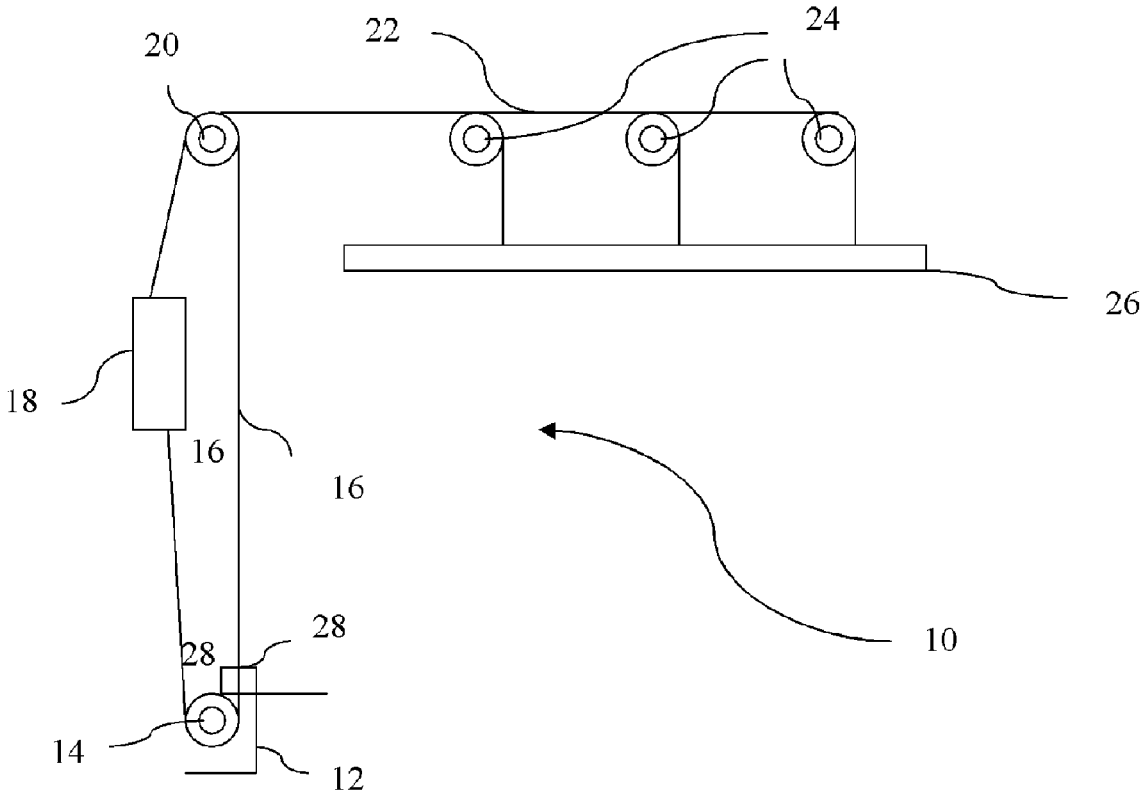
Figure 1 Prior Art
FIG. 1 is an elevation view of a prior art counterweight rigging system.
Figure 2:
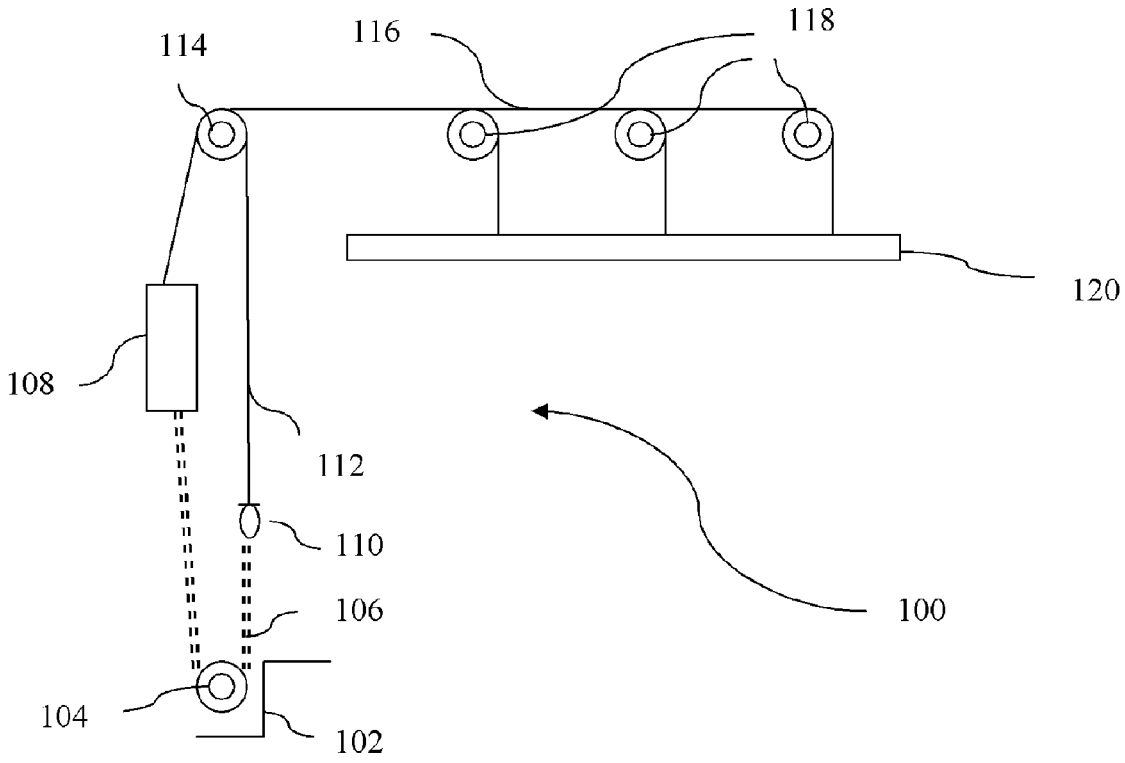
FIG. 2 is an elevation view of a counterweight rigging system in accordance with a preferred embodiment of the present invention.

Referring now to the drawings, wherein like reference numerals refer to like parts throughout, there is seen in FIG. 2 a counterweight rigging system, designated generally by reference numeral 10, essentially comprising a locking rail 102 anchored to the floor or other fixture/building structure, a winch 104 positioned on rail 102, a drive chain 106 that extends between a counterweight arbor 108 and a junction point 110 on the opposite side of winch 104, a conventional rope 112 that extends between junction point 110 around a head block 114 and down to the opposite side of arbor 108 as drive chain 106. System 100 further comprises conventional lift lines 116 that extend from arbor 108 and around head block 114 and loft blocks 118 and then down to a batten 120 to which a load (such as scenery, lighting, curtains, sound equipment, and the like) is attached.

The present invention substitutes drive chain 106 and motor driven winch 104 for conventional control line 16, rope lock 28 and tensioning floor block 14. In addition, arbor 108 is initially loaded with a predetermined amount of weight equal to 50% of the counter weight system capacity, and does not need to be adjusted after it is fixed. Winch 104 is preferably rated at 50% of the counterweight system capacity, anywhere between 0% to 100% of the counterweight system rated capacity. Therefore, if batten 120 (and hence the load) needs to be raised or lowered, winch 104, in conjunction with the fixed counterweight, raise and lower a load anywhere between 0% to 100% of the counterweight system rated capacity without having to increase or decrease the amount of counterweights loaded on arbor 108.

Figure 3A:
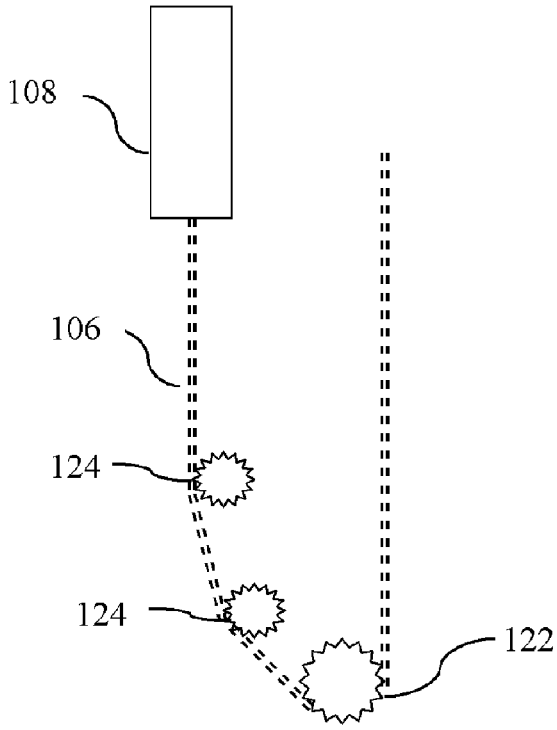
FIG. 3A is a detailed elevation view of the drive chain and winch portions of the present invention.
Figure 3B:
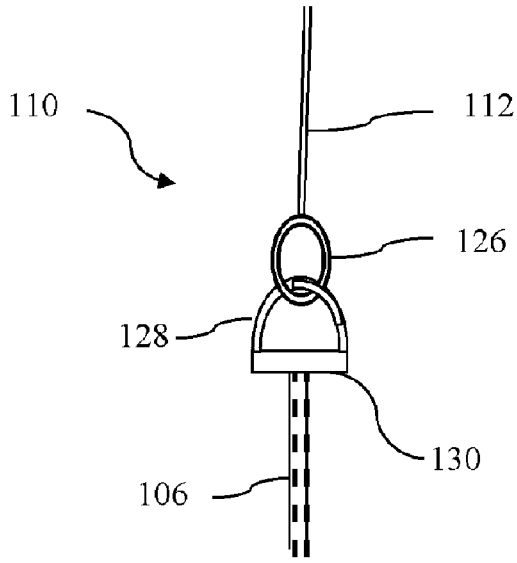
FIG. 3B is an enlarged elevation view of the junction point between the drive chain and rope.

With reference to FIG. 3A, drive chain 106 is fixed at one end to the bottom of arbor 108, extends around a drive sprocket 122 within winch 104, around idler sprockets 124 which redirect its orientation to run parallel with that portion extending outwardly from arbor 108, and terminates at junction point 110. Junction point 110 comprises any conventional fastening mechanism, such as an eye 126 to which rope 112 attaches, and a shackle 128 with a pin 130 passing through the last link of drive chain 106 fixing it to the shackle, as shown in FIG. 3B. Other conventional fastening systems for interconnecting two lines could work as well.

The motorized winch 104 could be located at any point along the drive chain 106, although it is preferred that it be located at or near the floor. Other positioning locations are, however, possible and well known to those skilled in the art.

In addition to the preferred embodiment disclosed herein, there are several other different approaches to how the winch drives the control line.

For example, on existing systems the control line (collectively, the drive chain 106 and rope 112 in the preferred embodiment) is a manila or synthetic rope, typically ¾ diameter. A winch that could engage the rope in a manner that would provide a positive drive (no slipping) could be implemented using serpentine rollers or similar structure.

Alternatively, the control line could be replaced entirely with a roller chain, or other flexible medium with the ability to be positively driven. The challenge with this approach is that the head block and floor block of existing systems typically have grooves to accommodate ¾" diameter rope. Replacing the head block is labor intensive and expensive.

The motorized winch 104 would preferably include a motor, gear reducer, mechanism to drive the control line (serpentine rollers, sprocket wheel, etc.), a limit switch to control the limits of travel, a starter or variable speed drive, and a control system. The control system could be simple Up/Down pushbuttons or one of the programmable position controllers developed for use with the PowerLift™ rigging system manufactured and sold by J.R. Clancy, Inc. of Syracuse, N.Y. Other sensing and safety devices could be added.

To ensure the winch/system are not overloaded a method of ensuring weight cannot be added to or taken from the arbor must be included. The weights could be banded in place with steel strapping tape, and a filler installed on top of the weights to prevent the addition of more weights.

What is claimed is:

1. A counterweight balanced rigging system for raising and lowering a load of predetermined weight, comprising:

a winch having a rating of at least one half the predetermined weight;

an arbor having counterweights positioned thereon, wherein the weight of the counterweights is about one half of the predetermined weight;

a first control line interconnecting said arbor to the load; and a second control line interconnected between said arbor and said first control line and positioned in movingly and lockingly engaged relation to said winch.

2. The system of claim 1, further comprising a head block around which said first control line passes and that alters the direction of said first control line.

3. The system of claim 2, further comprising a loft block positioned between said head block and said load, and around which said first control line passes and that alters the direction of said first control line.

4. The system of claim 1, wherein said second control line comprises a drive chain.

5. The system of claim 1, further comprising an idler sprocket positioned between said winch and said arbor and in engaged relation with said second control line.

6. The system of claim 1, wherein said rating of said winch is selectively adjustable between 0 and 100% of its maximum rating.

7. A winch and control line assembly for a rigging system for raising and lowering a load of predetermined weight, the rigging system including an arbor and counterweights mounted on the arbor that collectively weigh about half of the predetermined weight, the winch and control line assembly comprising:

said winch having a rating at least half of the predetermined weight;

a first section of said control line extending between the load and the arbor; and a second section of said control line extending between said first section and the arbor and movingly and lockingly engaging the winch.

8. The winch and control line assembly of claim 7, wherein said rating of said winch is selectively adjustable between 0 and 100% of its maximum rating.

9. The winch and control line assembly of claim 7, wherein said second section of said control line comprises a drive chain.

* * * * *